US005918614A

United States Patent [19]

Lynch

[11] Patent Number: 5,918,614

[45] Date of Patent: Jul. 6, 1999

[54] CONFIGURABLE SHADE STRUCTURE INCLUDING A KIT AND METHOD THEREFOR

[76] Inventor: James P. Lynch, 13 S. Field, Lakewood, Colo. 80226

[21] Appl. No.: 08/183,066

[22] Filed: Jan. 18, 1994

[51] Int. Cl.[6] ..... E04H 15/30

[52] U.S. Cl. ..... 135/95; 135/115; 135/119; 135/114

[58] Field of Search ..... 135/98, 99, 114, 135/115, 119, 124, 138, 156, 141, 142, 128, 137, 95

[56] References Cited

U.S. PATENT DOCUMENTS

| | | | |
|---|---|---|---|
| 2,873,750 | 2/1959 | McCarthy | 135/98 |
| 3,060,949 | 10/1962 | Moss | 135/115 X |
| 4,285,355 | 8/1981 | Lundblade | 135/156 X |
| 4,537,210 | 8/1985 | Montgomery | 135/115 X |
| 4,580,372 | 4/1986 | Osborn | 52/3 |
| 4,642,868 | 2/1987 | Pandell | 135/115 X |
| 4,677,999 | 7/1987 | Cannon et al. | 52/222 X |
| 4,914,767 | 4/1990 | Balicki et al. | 135/118 X |
| 4,942,895 | 7/1990 | Lynch . | |
| 5,161,561 | 11/1992 | Jamieson | 135/98 X |
| 5,198,287 | 3/1993 | Samson et al. | 135/115 X |
| 5,234,011 | 8/1993 | Lynch | 135/114 X |

FOREIGN PATENT DOCUMENTS

| | | | |
|---|---|---|---|
| 0918136 | 2/1963 | United Kingdom | 135/99 |

OTHER PUBLICATIONS

Fabrics & Architecture, May–Jun. 1993, p. 52 and third photocopied page (bottom left).

Fabrics & Architecture, Dec., 1992, p. 62.

Fabrics & Architecture, May–Jun. 1991, second photocopied page (top center).

Fabrics & Architecture, May–Jun. 1991, p. 26.

Fabrics of Architecture, Dec. 1992, p. 48.

Industrial Fabric Products Review, Dec. 1991, pp. 81 and 83.

Industrial Fabric Products Review, Dec. 1992, p. AA–13.

Industrial Fabric Products Review, Dec. 1991, fourth photocopied page.

Industrial Fabric Products Review, Dec. 1992 p. AA–22.

Fabrics & Architecture, Mar.–Apr., 1992, p. 9.

Industrial Fabric Products Review, Dec., 1992, p. AA–22.

*Primary Examiner*—Lanna Mai

*Attorney, Agent, or Firm*—Timothy J. Martin; Michael R. Henson

[57] ABSTRACT

A canopy structure, kit and method permits a user to custom configure a canopy shelter is almost unlimited curvilinear shapes. To accomplish this, a flexible sheet that is elastic in at least one, but preferably two dimensions may be secured over an area to be sheltered. Anchors connect the sheet either directly to the surface, such as the ground, or to an object, such as a tree or building, secured to the surface. A support pole is interposed between the surface and the sheet; and this support pole is sufficiently long to deform the sheet in the direction(s) of elasticity and thus exert a compression force on the pole. A plurality of support poles of varying lengths may be formed from identical pole sections, and base plates and dome elements may be used on the poles. The anchors are formed to engage the edge margin of the sheet at random locations, and these anchors, or alternative clasps, may engage the central portion of the sheet so that even greater design flexibility is possible. The sheet is preferably spandex and may be coated with protective materials, and it may be printed with a desired pattern.

32 Claims, 5 Drawing Sheets

60
70
42
40
42
42
52
52

44
48
42
42
40
40
58
54
56

20
24
26
32
22
30
28

20
24'
26
34
36

62
68
60
70
66
66
64
72
48
72
42

26
80'
82'
116
22
80
82
24
84
20

CONFIGURABLE SHADE STRUCTURE INCLUDING A KIT AND METHOD THEREFOR

FIELD OF THE INVENTION

The present invention generally relates to fabric structures and, in particular, to tensioned fabric structures used as canopies. More specifically, however, the present invention concerns a canopy structure which may be provided in kit form whereby a user may create a customized canopy configuration in a variety of aesthetically pleasing yet functionally operative forms. To this end, the present invention also contemplates a method of producing such a canopy structure.

BACKGROUND OF THE INVENTION

The need for various types of shelters from environmental elements, such as the sun, wind and rain, has long been recognized. Moreover, the advantages of having shelter structures which may be easily erected for use yet disassembled for storage has been realized. Thus, for example, tent structures have often been called upon to serve as dwelling units for sleeping, cooking or other living functions either for temporary or permanent use. Larger, "area shelters" have been developed to provide a pavilion structures that are, for example, commonly used in commercial, fair, exhibit and party applications such as used in traveling shows and exhibits, merchandise exhibits, carnivals and the like.

Utilitarianism has historically influenced shelter construction as a predominant concern. That is, most shelter structures has been designed primarily from a functional standpoint with less regard for aesthetic features. Some efforts have been made in recent years to create canopy or tent structures that not only provide shelter but which are also more aesthetically pleasing to the viewer. These developments have, in part, stemmed from improvements in fabric technology, such as the development of lighter-weight, stronger materials that more readily accept tension forces and which tend to better retain their shape in environmental conditions.

One such example of a structure with both aesthetic design and utilitarian function is found in my U.S. Pat. No. 4,942,895 issued Jul. 24, 1990 and entitled "Tensioned Tent Structure And Erection Method Therefor". This portable shelter is also subject of my design patent, Des. No. 326,133 issued May 12, 1992. In the '895 patent, a tensioned fabric structure is described wherein a flexible covering is configured to have one or more vertex portions and a peripheral edge which may be anchored at corner portions to a support surface. A pole assembly is associated with each vertex portion to elevate the vertex portion over the support surface and thereby provide a protected space for activities. Tension is placed upon the fabric structure by adjustably varying the effective length of the pole assemblies.

Another example of an aesthetically pleasing tent structure is shown in my U.S. Pat. No. 5,234,011 issued Aug. 10, 1993 and entitled "Clear Span Tent Structure". This shelter structure utilizes a flexible covering that has a center portion and a plurality of ridge portions which terminate at peaks located proximate to the coverings periphery so that the inclined slopes of the ridge portions form valley portions that extend radially outwardly from the central portion between a pair of adjacent ridge portions which also extend radially outwardly from the central portion. Support poles are located around the periphery to support the peak portions, and anchors secure the flexible covering to a support surface so that a ridge tension force is applied along each ridge line in a direction upwardly and outwardly with respect to the central portion and a valley tension force is applied along each valley floor in a direction downwardly and outwardly with respect to the central portion thereby holding the flexible covering in a taut condition when erected.

The integration of art and engineering with respect to fabric structures is further exemplified by fabric structures produced by Transformit, Inc. of Portland, Me., USA and by Bill Moss, Inc., of Scottsdale, Ariz., USA. The products produced by Transformit, Inc. are generally one of a kind pieces commonly referred to as fabric sculptures wherein large panels of fabric are specially configured and are stretched into a curvilinear contours, typically by guy wires. Not only are these products aesthetically pleasing, but they are also functional in providing shade and other shelter. A primary material used by Transformit, Inc. is spandex-nylon fabric. The products of Bill Moss, Inc., are often one of a kind tensile-structure canopies which are supported by guy wires, rigid poles and/or arched resilient poles. In each case, these products require specially configured panels to establish the unique curvilinear contour selected by the designer.

While the above described products have advanced the art of canopies, tents and shelters, they nonetheless have certain limitations and disadvantages. For example, the structures described in the '895 and '011 patents will have a standard appearance that is reproduced each time the tent or canopy is erected. While the products described in the '895 and '011 patents are readily erected and disassembled, these structures rely on specific anchor points and pole locations so that proper tensioning of the protective covering is assured each time the unit is erected.

Likewise, the structures of Bill Moss, Inc. are constructed to have a standard appearance when erected or, where designed to be one of a kind sculptures, are specifically configured to have a unique appearance. Similarly, the fabric sculptures of Transformit, Inc. are designed to take on a specific, unique appearance upon installation. Accordingly, the cost of each unique design can be very expensive. Indeed, the fabric structural sculptures of Bill Moss, Inc. and Transformit, Inc., typically rely on custom installation which greatly increases the cost and does not lend itself to repeated erection and disassembly for storage. Thus, none of these products allow for varied custom design enabling the user to establish different aesthetic appearances with the same structural elements.

Accordingly, there remains a need for an improved canopy or shade structure which can be set up and dismantled by an ordinary user whereby the user may create an almost unlimited variety of aesthetic appearances. There is a further need for such a shelter which is sufficiently inexpensive to be within the economic reach of a larger portion of the population than is heretofore possible with unique, one of a kind shelters. The present invention has been developed to meet these needs.

SUMMARY OF THE INVENTION

It is an object of the present invention to provide a new and useful canopy-type shelter which can be configured by a user into a variety of different customized configurations having a high degree of aesthetic appeal.

Another object of the present invention is to provide a canopy-type shelter and the method for producing such a shelter that allows an ordinary user who lacks specific artistic training to nonetheless create a fabric sculpture/shelter of high artistic design.

Another object of the present invention is to provide a canopy-type shelter and method for producing the same whereby a user may easily produce a unique combination fabric sculpture and shelter with relative ease.

Yet another object of the present invention is to provide an inexpensive shelter which can nonetheless produce a fabric sculptural/shelter of substantial appeal and which structure may be produced in kit form.

Still a further object of the present invention is to provide a fabric shelter that may be erected and dismantled repeatedly with minimal effort and, when erected, may be erected in different custom configurations.

According to the present invention, a canopy structure is provided which is adapted to be erected over a surface area in custom configurations in order to shelter a space thereunder. This canopy structure may be packaged in a kit form whereby ordinary users may erect such a canopy structure, and the present invention contemplates a method for providing such a sheltered space.

Broadly, the canopy structure according to the present invention utilizes a flexible sheet of material that is elastic in at least one direction of elasticity and which is configured in a selected geometric shape so that it has a central portion that is surrounded by an edge margin. This sheet may be deformed into a stretched state, and, due to its elasticity, thereby exerts a restoring force that acts to return the sheet to the relaxed state having the selected geometric shape. A plurality of anchors are provided and are operative to secure the edge margin to a support surface whereby the sheet is retained over the surface are to be sheltered. A support pole is interposed between the support surface and the sheet while the sheet is secured to the support surface, and the support pole is of sufficient length to cause the sheet to deform in the direction of elasticity thereby creating an apex and, correspondingly, elevating an apexial portion of the sheet above the support surface. The restoring force exerted by the sheet accordingly is operative to apply a compression force on the pole.

Preferably, the flexible sheet is polygonal in shape and may be constructed as either a single panel piece or a plurality of panel sections. Moreover, the sheet is preferably elastic in at least two dimensions, that is, in first and second orthogonal directions of elasticity. In any event, the sheet is selected to be one which will expand approximately three times the area when in its relaxed dimension and, for example, may be spandex. The elastic sheet may be provided with a protective coating such as a coating selected from a group of materials consisting of waterproofing materials, fire-retarding materials, reflective materials, ultra-violet resisting materials and polytetrafluoroethylene.

While it is possible to employ a single support pole, it is desirable to use a plurality of support poles to create a wider variety of customized shapes. Here, each pole is adapted to be interposed between the support surface and the sheet thereby to deform the sheet to create a plurality of apices and corresponding elevated apexial portions. The poles may be constructed of pole sections of a standard section length so that each of the support poles may be incremented in length by the number of pole sections combined into the respective support pole. A dome element may be provided on a first end of the pole which is positioned against the sheet at the apex, and this dome element can have a circumferential surface that is parallel to the pole when located thereon. The dome element may be constructed of a plastic material. Moreover, a base member may be provided at the end of each support pole which bears against the support surface, and a base member may include a spike adapted to penetrate the support surface.

The anchors which attach to the edge margin of the sheet may be releasably securable thereto. Here, the peripheral edge margin of the sheet may be enlarged either by rolling a mass of the edge into a roll or by providing a sleeve into which an elastic cord is inserted. The anchor may be constructed also to enable it to engage a central portion of the sheet, or alternatively, an auxiliary clasp element may be provided to releasably secure a central portion of the sheet so that the central portion may be tethered either to the support surface or to an object located on the support surface.

Where packaged in the kit form, the flexible sheet, the pole sections and the anchors are received in a container sized and adapted to store the respective parts. This kit may include dome elements and a dome adapter so that a pair of dome elements may be mounted on a selected pole section in order to support opposite ends of the container. Here, the container may be formed as a flexible bag that has a selected bag length that is approximately the same as the pole section length so that the pole section with the pair of dome elements secured thereto may keep the bag in an expanded state. Again, clasp elements, base elements and tethers may be provided in the kit.

According to the broad method of the present invention, a user provides a sheltered space over a surface area by placing a sheet of flexible, elastic material of selected geometric shape over the surface area to be protected. An edge margin of the sheet is then anchored at a plurality of locations to the surface area whereby the sheet is retained over the surface area to be sheltered. A support pole is then interposed between the surface area and the sheet while the sheet is secured to the support surface with the support pole being of sufficient length to cause the sheet to deform in the direction of elasticity thereby creating an apex and elevating an apexial portion of the sheet above support surface. The restoring force exerted by the sheet thereby applies a compression force on the pole. This method may also include the step of interposing a plurality of support poles of different lengths between the surface area and the sheet at selected random locations to create a plurality of apices so that the sheet is deformed into a customized appearance. Also, the method may include the step of engaging a central portion of the sheet at a selected random location and thereafter tethering the central portion to the support surface or to an object supported on the support surface thereby to deform the sheet.

These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENTS

The present invention is directed to canopy-type shelters which can be erected over a surface area in order to protect the space between the surface area and the canopy shelter so that various activities can be conducted with protection from environmental elements afforded by the canopy shelter. A principle aspect of the present invention is the ability to create different custom contoured shelters having aesthetic appeal without the need for uniquely sized and configured canopy panels. Accordingly, the present invention seeks to provide a kit and a canopy erection method allowing almost anyone to create his/her own variety of custom configurations for such a canopy shelter. Broadly, the kit, and thus the canopy shelter, of the present invention employs a flexible sheet of elastic material, a plurality of anchor/clasp members that are operative to secure the sheet to a support surface and one or more support poles which may be used to support randomly selected apexial portions of the flexible sheet above the support surface thereby to create the protected space.

Figure 1:
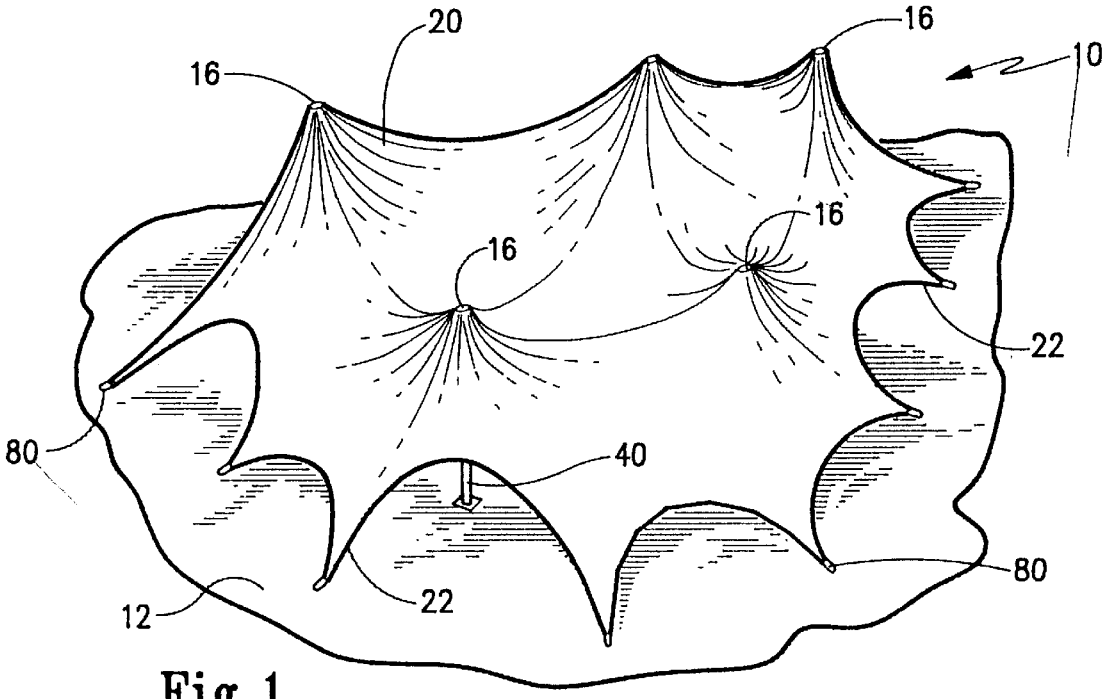
FIG. 1 is a perspective view of a canopy structure according to the present invention mounted on a support surface.
Figure 2:
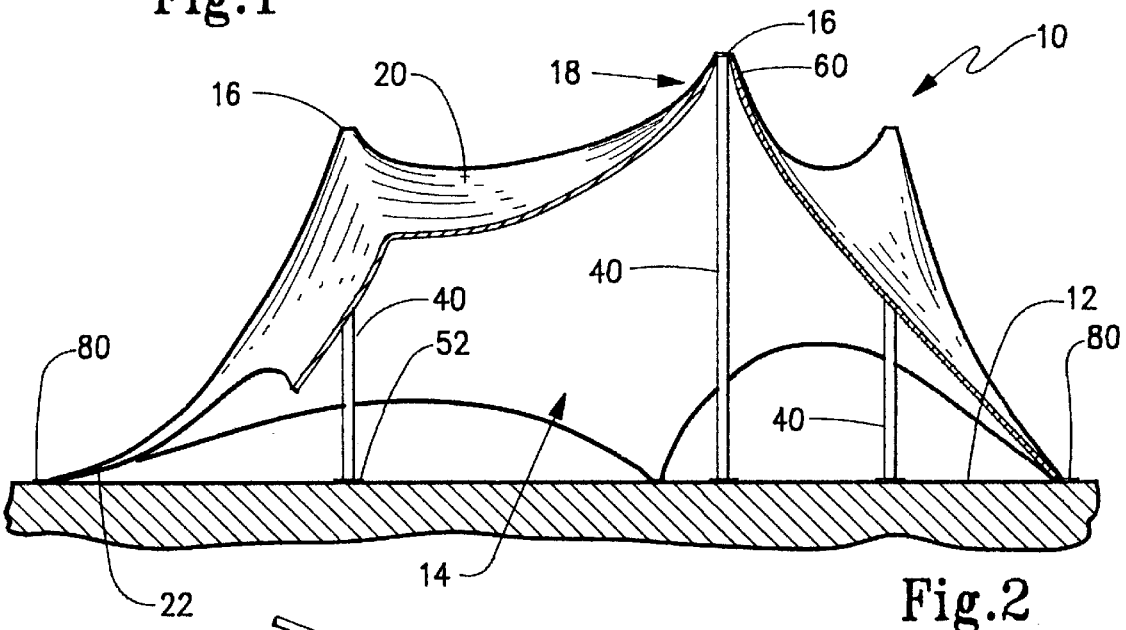
FIG. 2 is a side view in cross-section of the canopy structure of FIG. 1.

Accordingly with reference to FIGS. 1 and 2, it may be seen that a canopy structure 10 according to the present invention is adapted to be erected on a support surface 12 in order to protect a sheltered space 14 from the sun, rain, wind or other environmental conditions. As is shown in these figures, canopy structure 10 utilizes a flexible sheet 20 that may be anchored, for example, along its peripheral edge 22 by a plurality of anchors 80. Flexible sheet 20 is formed of a selected geometric shape, and it is fabricated from a material that is elastic in at least one direction of elasticity so that flexible sheet 20 may be stretched and thereby deformed in the direction of elasticity. When in the stretched state, a restoring force due to the elastic property acts to return the sheet to the relaxed state having the selected geometric configuration. As is shown in FIG. 1 and 2, stretching sheet 20 is accomplished by means of a plurality of support poles 40 that create apices 16 and thus support apexial portions 18 above support surface 12.

Figure 3:
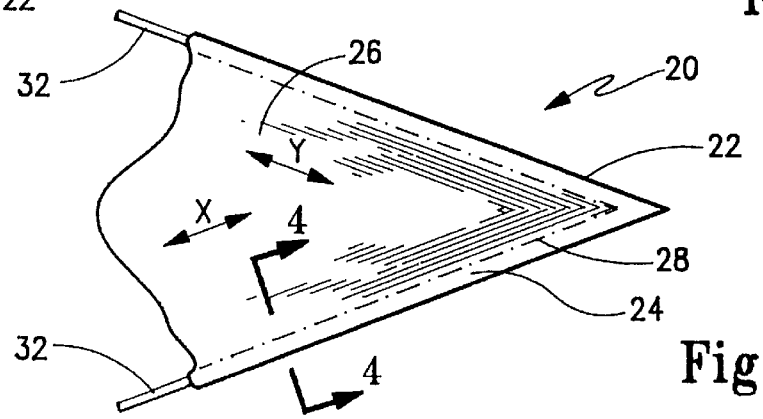
FIG. 3 is perspective view of a corner of the flexible sheet used to form the canopy structure of FIGS. 1 and 2.

As noted above, flexible sheet 20 may be configured in its relaxed state to have any geometric shape and relaxed area; it is preferred, however, that the shape be polygonal in nature, for example, squareshaped or rectangular. It should be understood that it is within the scope of this invention that any geometric shape could be utilized. Moreover, it is preferred that the flexible sheet 20 be formed as a single, integral panel of material which is elastic in two-dimensions, that is, in two orthogonal directions so that sheet 20 has a memory for its original polygonal shape. Thus, as is depicted in FIG. 3, sheet 20 is elastic along the orthogonal "x" and "y" axes. Preferably sheet 20 may expand to an expanded area that is at least approximately three (3) times its relaxed. An example of a suitable sheet material is spandex. Sheet 20, if desired, may be treated or coated with a variety of protective materials, and these materials may be selected from a group consisting: water-proofing materials, fire-retarding materials, reflective materials, ultra-violet resisting materials and polytetrafluro-ethylene.

Figures 4, 5, 6, 7, 8, 9:
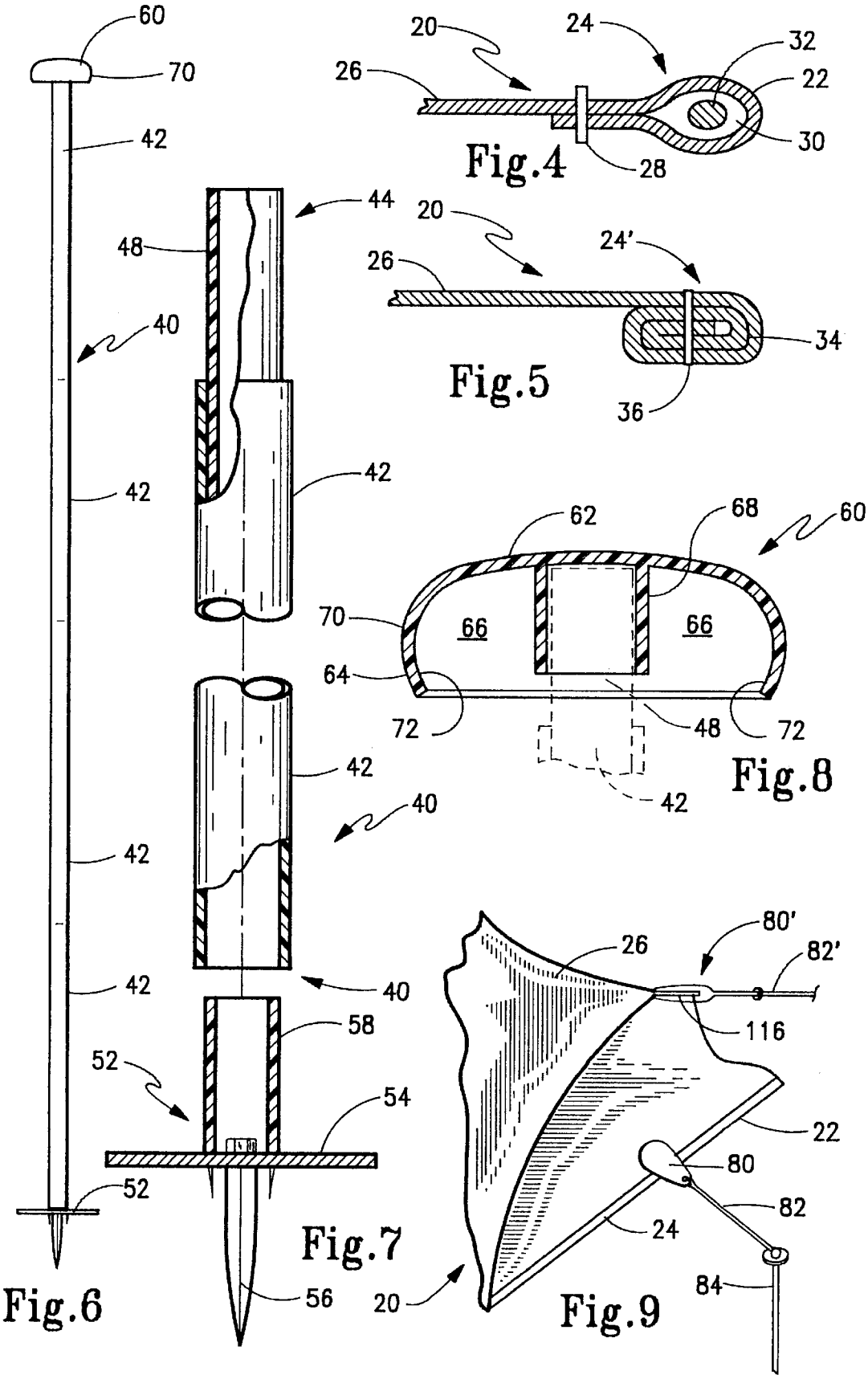
FIG. 4 is a cross-sectional view taken about line 4—4 of FIG. 3.
FIG. 5 is a cross-sectional view, similar to FIG. 4, but showing an alternative construction for the edge of the flexible sheet of FIG. 3.
FIG. 6 is a side view in elevation of a support pole, base member and dome element used with the canopy structure of FIGS. 1 and 2.
FIG. 7 is an enlarged side view, in partial cross-section, of the support pole of FIG. 6.
FIG. 8 is a side view in cross-section of a dome element used with the support pole of FIG. 7 as shown in FIG. 6.
FIG. 9 is a perspective view of a portion of the flexible sheet of the canopy structure of FIGS. 1 and 2 shown engaged at both at an edge margin and at a central portion by means of identical anchors that anchor the flexible sheet to the support surface or an object on the support surface.

As is shown in FIG. 3 and 4, an edge margin 24 of sheet 20 is located adjacent peripheral edge 22 of sheet 20 and thus surrounds a central portion 26 thereof. Edge margin 24 is enlarged so that it may be readily engaged by anchors 60. For example, as is shown in FIG. 4, edge margin 24 is formed by folding an edge portion of sheet 20 back on itself and securing this fold by means of stitching 28 to create a sleeve structure 30 having a rivers that defines edge 22. Sleeve structure 30 receives an elastic cord 32 which may also stretch when sheet 20 is deformed. An alternative construction for edge margin 24 is shown in FIG. 5 wherein edge margin 24' is formed by rolling an edge portion of sheet 20 on itself to create a rolled mass 34 that is then stitched together by stitching 36 thus eliminating cord 32.

At least one, but preferably a plurality of support poles 40 are employed to support flexible sheet 20 above the support surface, as noted above, and are interposed between support surface 12 and sheet 20 when anchored thereto. A representative support pole 40 is thus shown in FIG. 6 and 7 along with its associated base and dome elements. With reference to these figures, it may be seen that each support pole 40 is constructed of a plurality of identical support pole sections 42 of hollow tubular construction. Pole sections 42 may be constructed of any suitably strong, light-weight material, such as aluminum, plastic and the like. Each pole section 42 has a first end portion 44 and a second end portion 46. End portion 44 is of reduced diameter compared to end portion 46 so that it may be telescopically received inside of second end portion 46 of an adjacent pole section 42. First end 44 may be fabricated by mounting a relatively shortened tubular piece 48 inside of an elongated tubular piece 50 which forms the main body of pole section 42. This mounting may be accomplished by means of an adhesive, welding or other such attachment techniques, as known in the art, depending upon the material selected for fabrication of each pole section 42.

It should be appreciated that a user may assemble and interchange a different number of the identical pole sections 42 to create support poles 40 of varying selected lengths, and that these support poles 40 may be interposed between flexible sheet 20 and the support surface 12 at selected random locations in order to create custom contours by stretching or "deforming" flexible sheet 20 along its direction or directions of elasticity. When sheet 20 is anchored, the restoring force acts to apply a compression force on each support pole 40.

To help retain support poles 40 in position on support surface 12, especially where support surface 12 is the ground, a base member 52 may be employed, as is best shown in FIGS. 6 and 7. Here, it may be seen that each base member 52 includes a flat plate 54 which is operative to rest against the support surface, and a spike element 56 may be bolted or otherwise attached to plate 54 so that it projects perpendicularly therefrom to penetrate the support surface. A post section 58 is coaxial with spike element 56 and extends oppositely thereof. Post section 58 is sized to be telescopically received inside of second end 46 of a lowermost pole section 42 opposite the end of the respective support pole 40 that supports its respective apexial portion 18. As is shown in FIG. 7, post section 58 is formed of a hollow tubular piece similarly sized to tubular piece 48 located at the first end 44.

In order to protect the apices 16 created by the stretching of flexible sheet 20, support poles 40 may be capped at an end opposite base member 52 by means of a dome element 60 best shown in FIGS. 6 and 8. As is shown in these figures, each dome element 60 is formed as an enlarged head out of an integral piece of material, such as molded plastic. With reference to FIG. 8, it may be seen that dome element 60 has a top wall 62 that is slightly rounded and from which downwardly depends a sidewall 64 to surround an interior 66. A socket 68 is centrally positioned on top wall 62 and projects in a common direction as sidewall 64. Socket 68 is sized to receive tubular piece 48 of an uppermost pole section 42 as shown in phantom in FIG. 8. Thus, dome element 60 is held in position on support pole 40. With reference again to FIG. 8, it may be seen that sidewall 64 is slightly curved to have an inwardly turned lip 72 with sidewall 64 having an exteriorly located circumferential surface portion 70 that is parallel to pole 40 when mounted thereon. This is desirable since it increases the surface area of contact of an apexial portion 18 of flexible sheet 20 located immediately adjacent each apex 16 thereby to reduce a likelihood of abrading the material used to construct flexible sheet 20. This is important since it is in the region of each apex 16 that flexible sheet 20 is under the greatest stress.

In order to secure the edge margin of flexible sheet 20 with respect to the support surface either directly or to an object supported on the support surface, or, where desired, the central portion 26 of flexible sheet 20 to either support surface 12 or to an object located on the support surface (such as a pole, wall, tree, etc.), a plurality of anchors 80 may be secured at selected random locations to either peripheral edge 22 or to central portion 26. It should be understood, of course, that defined anchor points along peripheral edge 22 re contemplated by this invention although the ability to select anchor locations randomly increases the ability to customize the appearance of the erected canopy.

Figure 10:
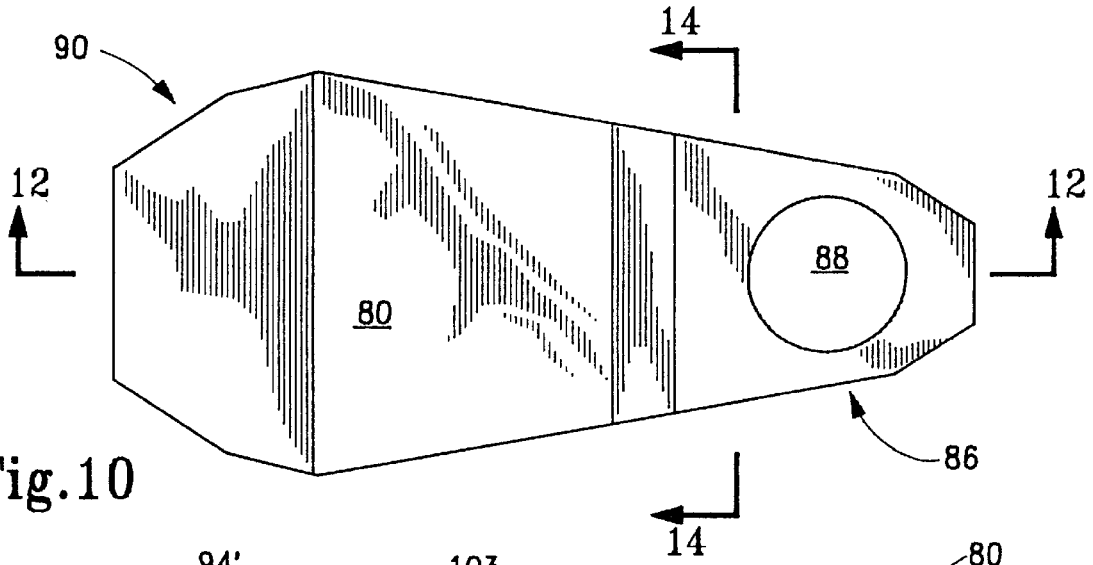
FIG. 10 is a top view of an anchor shown in FIG. 9.

Accordingly, as is shown in FIG. 9, an exemplary first anchor 80 engages an edge margin 24 and is tethered by means of a cord 82 to a stake 84 adapted to be driven into the support surface. A second anchor 80' acts as a clasp element that engages central portion 26 of flexible sheet 20 and is tethered by means of cord 82' to an object (not shown) that may be located on and also supported by the support surface. A representative anchor 80 is best shown in FIGS. 10–14, and, as is shown in FIG. 10, anchor 80 is spatulate in shape having a narrow end 86 provided with a circular opening 88 therethrough. A wider end 90 is provided to engage flexible sheet 20, as described below.

Figure 11:
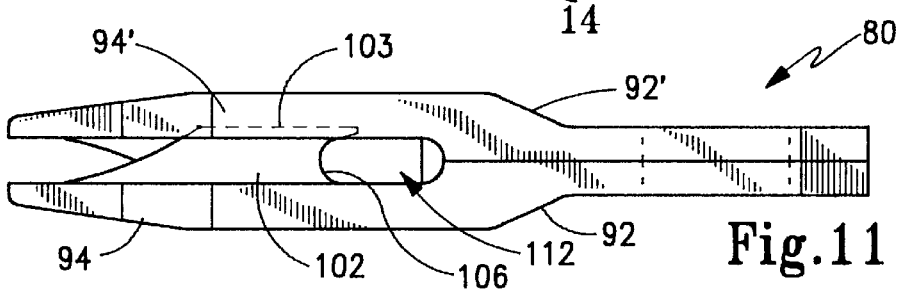
FIG. 11 is a side view in elevation of the anchor shown in FIG. 10.
Figure 12:
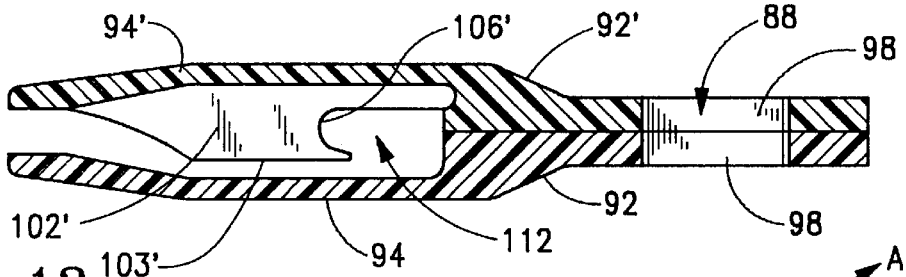
FIG. 12 is a side view in cross-section taken about lines 12—12 of FIG. 10.
Figure 13:
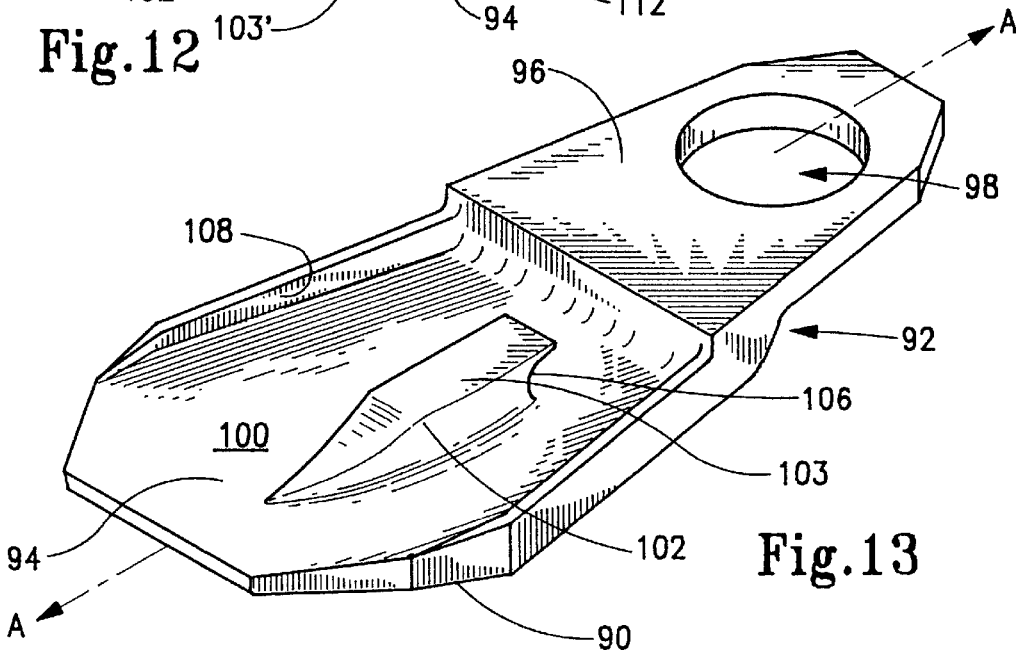
FIG. 13 is a perspective view of an anchor half used to produce the anchor of FIG. 10.

As is best shown in FIGS. 11–13, anchor 80 is constructed out of two identical sections or halves 92 that are joined together by adhesive, ultra-sonic welding or other techniques, again as known in the art. With reference to FIG. 13, it may be seen that a representative anchor half 92 is scoop-shaped in appearance having a scoop portion 94 attached to an arm 96. Arm 96 is provided with a circular opening 98 so that, when two anchor halves 92 are secured together, their respective openings 98 register with one another to form circular opening 88. The respective arm portions 96 of each anchor half 92 thus abut one another with respective scoop portions 94 being oriented generally parallel to one another in spaced apart relation as shown in FIGS. 11 and 12.

With reference again to FIG. 13, it may be seen that scoop portion 94 has an interior scoop surface 100 on which is disposed a retaining block 102 that extends from a location proximate to front edge 104 rearwardly to terminate in an arcuate rear surface 106. Retaining block 102 has an upper surface 103 opposite scoop surface 100. Moreover, retaining block 102 has a lateral width that is less than the width of wider end 90 so that it is located completely on one side of axis "A". An edge wall 108 is opposed to retaining block 102 on a side edge of wider end 90 of anchor half 92 on the other side of axis "A".

Figure 14:
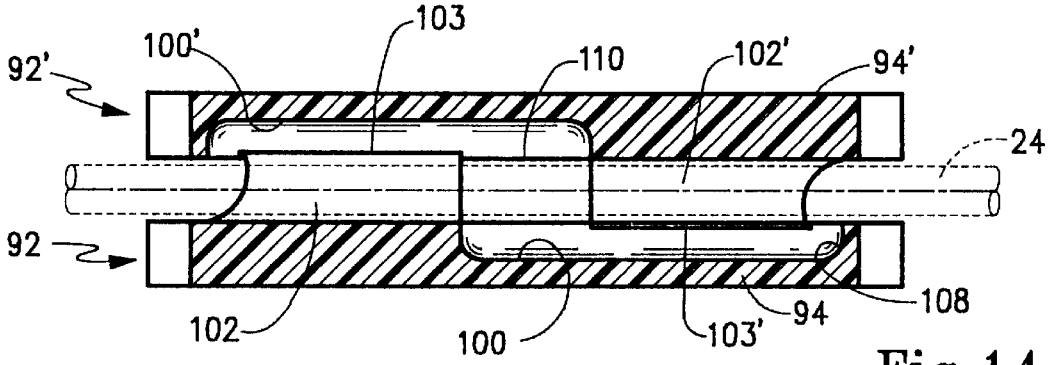
FIG. 14 is an end view in cross-section taken about lines 14—14 of FIG. 10.
Figure 15:
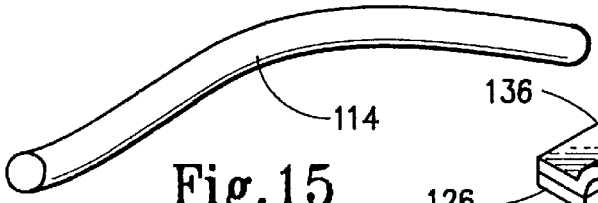
FIG. 15 is a perspective view of an auxiliary cord segment used with the anchor of FIG. 10 when used as a clasp member to engage a central portion of the flexible sheet such as shown in FIG. 9.

With reference to FIGS. 11, 12 and 14, it may now be appreciated that two anchor halves 92 may be joined so that scoop portions 94, 94' are substantially parallel to one another with the respective retaining blocks 102, 102' extending into the scoop portion 94, 94' of the other anchor half. Thus, as may be seen in FIG. 14, retaining block 102 on scoop surface 100 projects toward scoop surface 100' of scoop portion 94' so that upper surface 103 of retaining block is generally in spaced apart parallel relation to scoop surface 100'. Similarly, retaining block 102' of anchor half 92' projects downwardly into scoop portion 94 of anchor half 92 such that upper surface 103' of retaining block 102' is in generally spaced-apart, parallel relation to scoop surface 100 thereof. Retaining blocks 102 and 102' are thus opposed to one another and are separated by open region 110 with the rear surfaces 106 and 106' being laterally aligned along an axis transverse to axis "A". Open region 110 and the spaced apart relation of the retaining blocks from their opposed scoop surfaces allow edge margin 24 of flexible sheet 20 to be manipulated into lateral open region 112 (shown in FIG. 11) so that, when tension is applied to flexible sheet 20 by means of support poles 40, edge margin 24 becomes locked against rear surfaces 106, 106' of retaining blocks 102, 102' thus preventing release of the edge margin 24 from anchor 80. To engage a central portion 26 of flexible sheet 20, a fold is formed in central portion 26 and a short length of cord, such as cord segment 114 shown in FIG. 15, is positioned in the fold. Cord segment 114 along with the fold 116 (shown in FIG. 9) is mounted in lateral region 112 in a manner similar to that described with respect to the mounting of edge margin 24.

Figure 16:
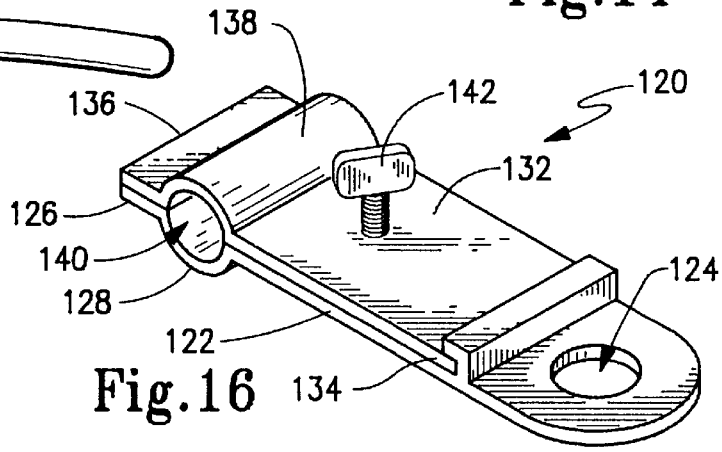
FIG. 16 is a perspective view of an alternative anchor especially constructed to grip an edge margin of the flexible sheet.

An alternative embodiment of an edge anchor for sheet 20 is shown in FIG. 16. Here, anchor 120 is formed by a base plate 122 that has a first end provided with an anchor opening 124 and a second end 126 having a laterally extending arcuate channel 128 formed proximately thereto. Base plate 122 has an upstanding lip 130 which releasably receives an end edge 134 of a retaining plate 132. Retaining plate 132 has a second end edge 136 and an arcuate channel 138 formed proximately thereto. When edge 134 is received in lip 130, channel portions 128 and 138 register with one another to provide a lateral retaining region 140 sized to receive the enlarged edge margin 24 of sheet 20. Edge margin 24 may accordingly be placed in channel portion 128 after which retaining plate 132 is positioned on base plate 122 and locked into position by means of thumb screw 142 thus trapping marginal edge 24 in lateral region 140.

Figure 17:
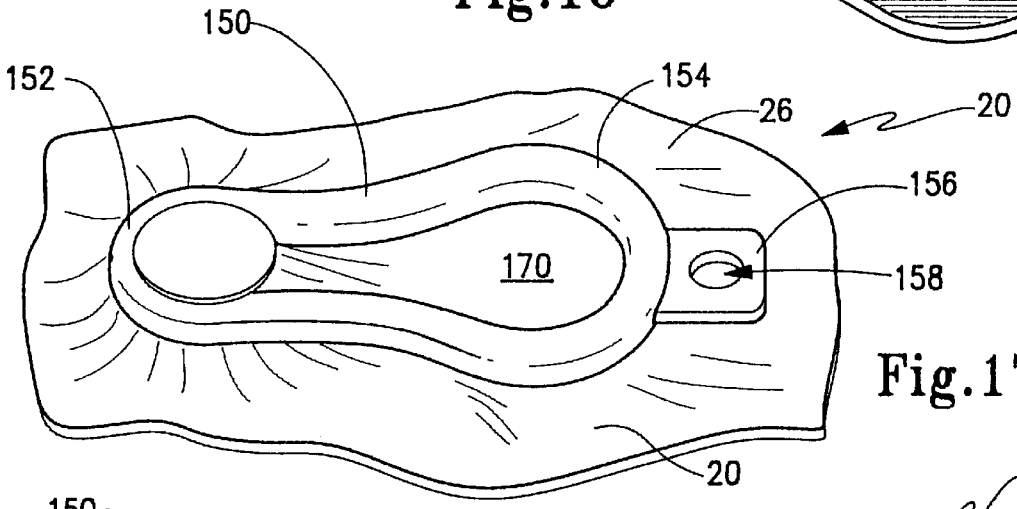
FIG. 17 is a perspective view of an alternative clasp member according to the present invention especially adapted to grip a central portion of the flexible sheet.
Figure 19:
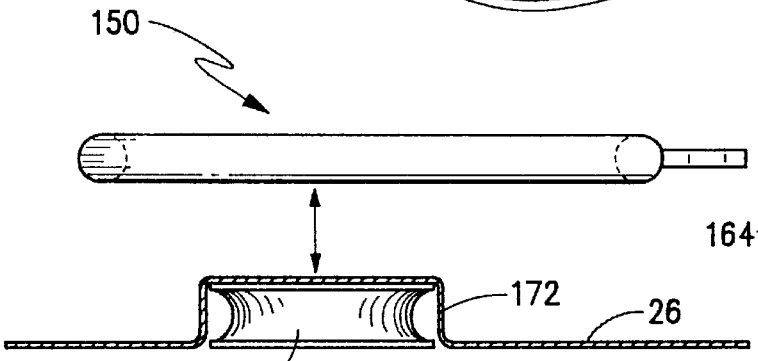
FIG. 19 is a side view, in partial cross-section, showing the engagement of the anchor of FIG. 17 on a flexible sheet.
Figure 18:
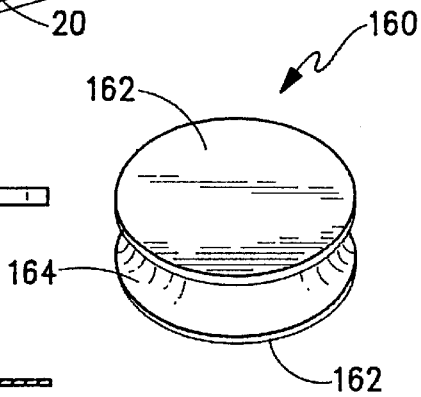
FIG. 18 is a perspective view of a disk insert used with the anchor of FIG. 17.

An alternative embodiment of an anchor used as a clasp element to engage a central portion 26 of flexible sheet 20 is shown in FIGS. 17–19. Here, clasp element or anchor 150 has a key-hole shape having a narrow end portion 152 and a wide end portion 154 onto which anchor tab 156 is positioned. Anchor tab 156 is provided with an anchor opening 158. A retaining disk 160 is formed by a pair of parallel plate-like portions 162 separated by a waisted central body 164, and retaining disk 160 is sized to pass into opening 170 formed by enlarged end portion 154 of anchor 150. As is shown in FIG. 19, retaining disk 160 is placed on one side of central portion 26 of flexible sheet 20 and anchor 150 is located on the opposite side of central portion 26. Disk 160 and an engaged portion 172 of central portion 26 of sheet 20 is then inserted into opening 170 of anchor 150. Anchor 150 is then advanced to move retaining disk 160 and engaged portion 170 into narrow end 152 that is sized to snugly engage waisted portion 164 of disk 160 thus locking disk 160 and engaged portion 172 of central portion 26 in anchor 150. Anchor 150 may then be tethered by means of anchor hole 158 to the support surface or to an object supported thereon.

Figure 21:
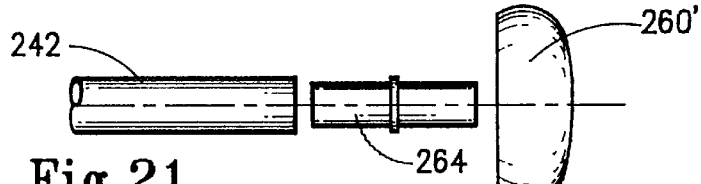
FIG. 21 is an exploded side view in elevation showing a dome adapter used with a pole section for storing the canopy structure in a bag-like container of FIG. 20.
Figure 20:
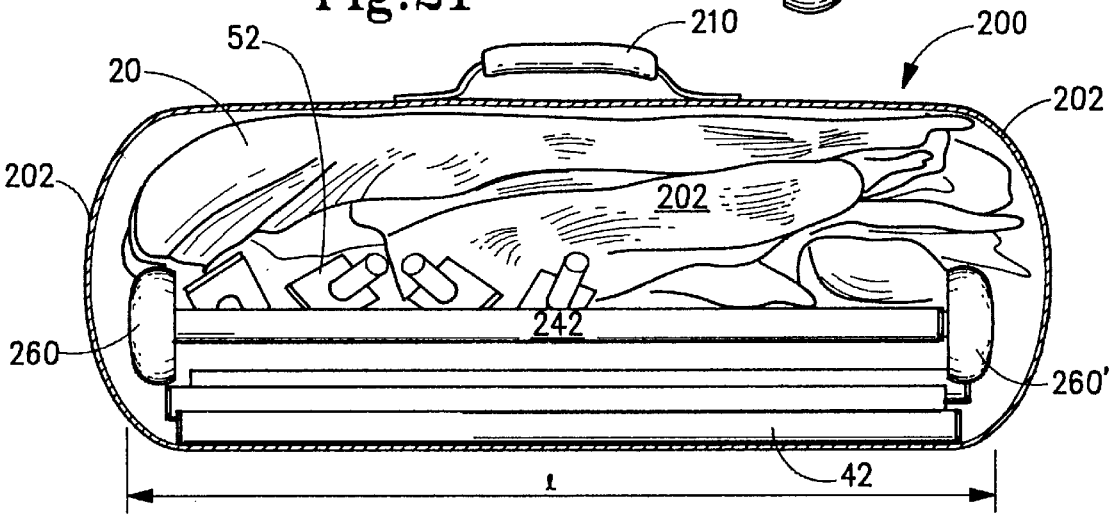
FIG. 20 is a side view, in partial cross-section, showing the canopy structure in kit form and stored in a bag-like container.
Figure 22:
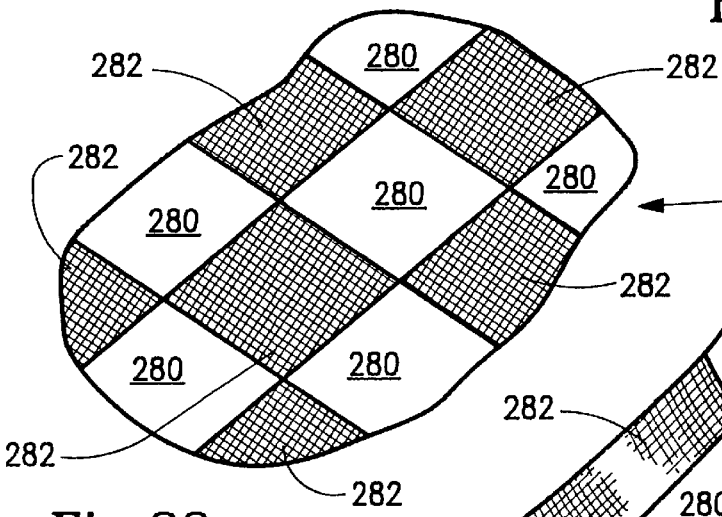
FIG. 22 is a perspective view of a portion of the flexible sheet in a relaxed state and showing a geometric pattern thereon.

As discussed at the beginning to this description, the canopy structure of the present invention may be contained in kit form. This is shown by way of representation in FIG. 20 where it may be seen that the kit form of the invention includes a container 200 that is sized and adapted to store flexible sheet 20, pole sections 42, dome elements 60, base members 52 and a bag 202 which can contain, for example, anchors 80 and suitable tether cords 82 therein. Container 200 is preferably in the form of a flexible tubular bag having a selected bag length "1" that is approximately the same as the length of a pole section 42. As is shown in FIGS. 20 and 21, a selected pole section 242 receives a dome element 260 on a first end thereof and a second dome element 260' at a second end thereof by means of an adapter 264 that is necessary since the diameter of socket 68 is the same as end portion 46 so that they each can receive an end portion 44 as described above. Dome elements 260, 260' thus are positioned to support opposite end panels 202 and 204 of bag-like container 200 thereby holding it in an open condition. A suitable strap handle 210 may be provided for ease of carrying.

Figure 23:
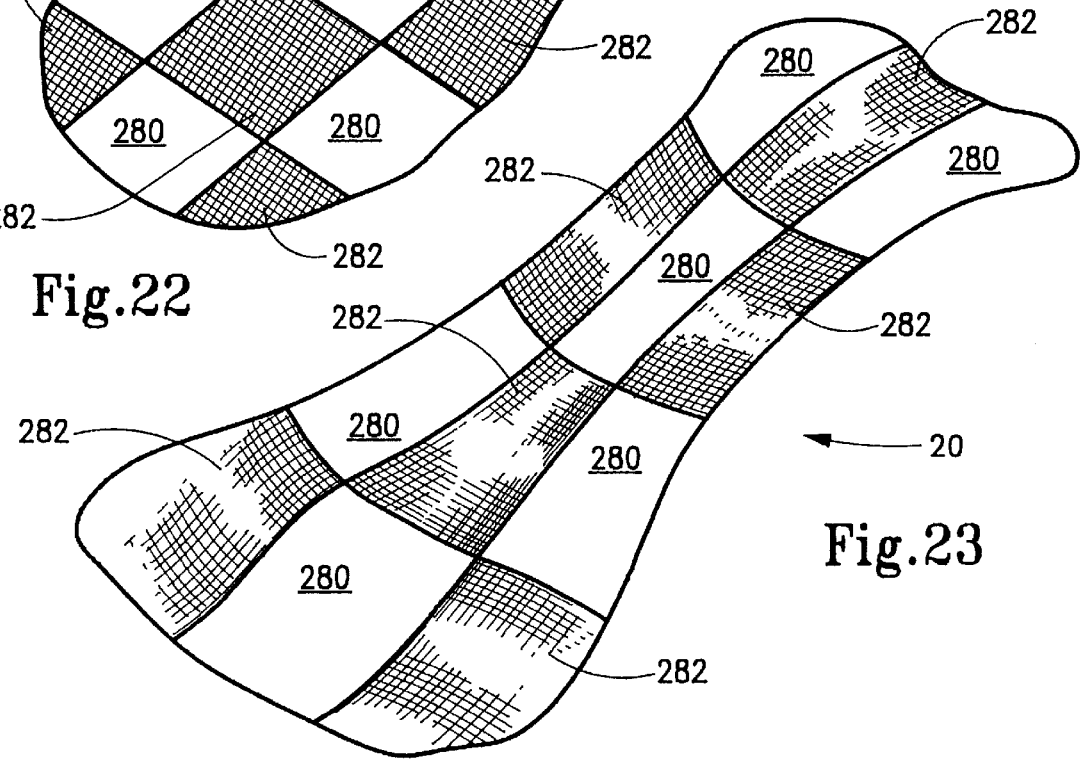
FIG. 23 is a perspective view of a sheet section shown in FIG. 22 but in an deformed state showing distortions to the geometric pattern.

From the above description, it should be understood that flexible sheet 20 can be neutral in color or tinted to have a uniform colorful appearance. Moreover, flexible sheet 20 can be printed with any desired pattern or decoration as artistically desired. An interesting effect, however, is accomplished by printing flexible sheet 20 with a uniform geometric pattern since the stretching of flexible sheet 20 into a deformed state will distort the geometric pattern along the contour of the sheet 20. By providing a geometric pattern, this contour can be visually emphasized. For example, as is shown for purposes of illustration only and not for limitation, it may be seen that flexible sheet 20 is provided with a uniform checkerboard pattern of light-squares 280 and dark-squares 282 when in the relaxed state. When deformed, as is shown in FIG. 23, this checkerboard pattern becomes distorted so that squares 280, 282 take different shapes while, at the same time, the lines of intersection of these squares extend as continuous curves. Thus, the deformation contours of this sheet become visually emphasized.

From the foregoing description of the canopy structure and the kit therefore, it should now be understood that the present invention contemplates a method of providing a shelter space over a surface area to be protected. This method comprises the first step of placing a sheet of flexible, elastic material of a selected geometric shape over the surface area to be protected wherein the sheet has a central portion surrounded by a margin edge. The method then includes the step of anchoring the edge margin of the sheet at a plurality of locations to the surface area whereby the sheet is retained over a surface area to be sheltered. Finally, the method includes the step of interposing at least one support pole between the surface area and the sheet while the sheet is secured to the support surface wherein the support pole is of sufficient length to cause the sheet to deform in the direction of elasticity thereby to create an apex and to elevate an apexial portion of the sheet above the support surface such that a restoring force exerted by the sheet is operative to apply a compressive force on the pole.

This broad method may further include the step of imposing a plurality of support poles of different lengths between the surface area and the sheet at selected random locations thereby to create a plurality of apices such that the sheet is deformed into a customized appearance. Furthermore, this method may include the step of engaging a central portion of the sheet at a selected random location and thereafter tethering the central portion to the support surface or to an object supported on the support surface thereby to deform the sheet. The method can also include the random engagement of the marginal edge of the sheet at selected random locations, the protection of the sheet at the apices by an enlarged head element and other such steps as are inherent in the description of the canopy structure above.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A canopy structure adapted to be erected over a surface area in custom configurations in order to shelter a space thereunder, comprising:

(a) a flexible sheet of a selected geometric shape when in a relaxed state and having a central portion surrounded by an edge margin that is adjacent to a peripheral edge thereof, said sheet formed of a material that is elastic in at least one direction of elasticity so that said sheet, when deformed into a stretched state will exert a restoring force that acts to return said sheet too the relaxed state;

(b) a plurality of anchors each operative to releasably secure to said edge margin with respect to a support surface whereby said sheet is retained over a surface area to be sheltered, said anchors each constructed to engage the peripheral edge at any selected random location therearound; and (c) a support pole adapted to be interposed between the support surface and said sheet at any selected random location within the central portion when said sheet is secured to the support surface, said support pole of sufficient length to cause said sheet to deform in the direction of elasticity thereby to create an apex at the selected random location and to elevate an apexial portion of said sheet above the support surface, the restoring force exerted by said sheet operative to apply a compression force on said pole.

2. A canopy structure according to claim 1 wherein said sheet is polygonal in shape.

3. A canopy structure according to claim 1 wherein said sheet is of a single panel construction.

4. A canopy structure according to claim 1 wherein said material is spandex.

5. A canopy structure according to claim 1 wherein said sheet is elastic in first and second orthogonal directions of elasticity such that said sheet, when deformed, will exert restoring forces in two dimensions.

6. A canopy structure according to claim 5 wherein said sheet may expand to an expanded area at least three times its relaxed area.

7. A canopy structure according to claim 1 including a plurality of support poles, each said support pole adapted to be interposed between the support surface and said sheet in an upright position and of sufficient length to cause said sheet to deform in the direction of elasticity when said sheet is anchored to the support surface, said support poles operative to create a plurality of apices and to elevate a plurality of apexial portions of said sheet above the support surface, the restoring force exerted by said sheet operative to apply a compression force on said support poles.

8. A canopy structure according to claim 7 wherein said support poles are of at least two different lengths.

9. A canopy structure according to claim 1 including a clasp element adapted to releasably engage a central portion of said sheet at any selected random location within said central portion.

10. A canopy structure according to claim 1 including a dome element located on a first end of said pole and operative to be positioned against said apex.

11. A canopy structure according to claim 10 wherein said dome element has a circumferential surface portion that is parallel to said pole.

12. A canopy structure according to claim 10 wherein said dome element is constructed of a plastic material.

13. A canopy structure according to claim 1 wherein said support pole is formed of a plurality of pole sections.

14. A canopy structure according to claim 1 wherein said sheet is provided with a protective coating.

15. A canopy structure according to claim 14 wherein said coating is selected from a group of material consisting of: waterproofing materials, fire retarding materials, reflective materials, ultra-violet resisting material and polytetrafluoroethylene.

16. A canopy structure according to claim 1 wherein said peripheral edge is enlarged.

17. A canopy structure according to claim 16 wherein said peripheral edge is formed be a rolled panel of said sheet that is secured together to form a roll.

18. A canopy structure according to claim 16 wherein said peripheral edge includes a sleeve, and including an elastic cord received in said sleeve.

19. A canopy structure according to claim 1 including a base member adapted to receive and support an end of said support pole opposite said apex.

20. A canopy structure according to claim 19 wherein said base member includes a spike adapted to penetrate said support surface.

21. A canopy structure according to claim 1 wherein said sheet is provided with a printed pattern that becomes altered in appearance when said sheet is deformed.

22. A canopy structure adapted to be erected over a surface area in custom configurations in order to shelter a space thereunder, comprising:

(a) a flexible sheet of a selected geometric shape when in a relaxed state and having a central portion surrounded by an edge margin, said sheet formed of a material that is elastic in two dimensions so that said sheet, when deformed into a stretched state will exert restoring forces in each of said two dimensions that acts to return said sheet to the relaxed state;

(b) a plurality of anchors operative to secured to said edge margin to a support surface whereby said sheet is retained over a surface area to be sheltered; and (c) a plurality of support poles each adapted to be interposed between the support surface and said sheet while said sheet is secured to the support surface, each said support pole being of sufficient length to cause said sheet to deform in the direction of elasticity thereby to create an apex and elevate an apexial portion of said sheet above the support surface, the restoring force exerted by said sheet operative to apply a compression force on each said pole.

23. A canopy structure according to claim 22 wherein said material is spandex.

24. A canopy structure according to claim 22 wherein said anchors are releasably securable to said edge margins portions.

25. A canopy structure according to claim 22 wherein said support poles are of at least two different lengths.

26. A canopy structure according to claim 22 including a clasp element adapted to releasably engage a central portion of said sheet.

27. A canopy structure according to claim 22 including a dome element located on a first end of each said pole and operative to be positioned against a respective said apex and including a base member adapted to receive and support an end of each said support pole opposite the respective said apex.

28. A canopy structure according to claim 22 wherein said support poles are formed of a plurality of interchangeable pole sections whereby poles of variable different lengths may be constructed.

29. A method according to claim 22 wherein said sheet has a peripheral edge with said edge margin being adjacent to said peripheral edge, said peripheral edge being elastic so that it may stretch while exerting a restorative force.

30. A method of providing a sheltered space over a surface area to be protected comprising the steps of:

(a) placing a sheet of flexible elastic material of a selected geometric shape over the surface area to be protected wherein said sheet has a central portion surrounded by an edge margin;

(b) anchoring the edge margin of said sheet at a plurality of locations to said surface area whereby said sheet is retained over a surface area to be sheltered; and (c) interposing a support pole between the surface area and said sheet while said sheet is secured to the support surface wherein said support pole is of sufficient length to cause said sheet to deform in the direction of elasticity thereby to create an apex and elevate an apexial portion of said sheet above the support surface, with a restoring force exerted by said sheet thereby operative to apply a compression force on said pole.

31. A method according to claim 30 including the step of interposing a plurality of support poles of different lengths between the surface area and said sheet at selected random locations thereby to create a plurality of apices such that said sheet is deformed into a customized appearance.

32. A method according to claim 30 including the step of engaging the central portion of said sheet at a selected random location and thereafter tethering said central portion to one of said support surface and an object supported on said support surface thereby to deform said sheet.

* * * * *